US005440982A

United States Patent [19]

Meadows et al.

[11] Patent Number: 5,440,982

[45] Date of Patent: Aug. 15, 1995

[54] INKING SYSTEM FOR A PRINTING PRESS

[76] Inventors: Stanley J. Meadows, 619 2nd St., Fort Wayne, Ind. 46808; Steven C. Waters, 3907 County Rd. 46A, Auburn, Ind. 46706

[21] Appl. No.: 85,592

[22] Filed: Jul. 1, 1993

[51] Int. Cl.[6] ..... B41F 31/05; B41F 31/08

[52] U.S. Cl. ..... 101/363; 101/366

[58] Field of Search ..... 101/349, 350, 351, 352, 101/363, 364, 365, 366, 207–210, 157, 169

[56] References Cited

U.S. PATENT DOCUMENTS

| | | | |
|---|---|---|---|
| 2,040,961 | 5/1936 | Stouch . | |
| 2,151,968 | 3/1939 | Henderson | 101/157 |
| 2,177,656 | 10/1939 | Kaddeland . | |
| 2,371,223 | 3/1945 | Crafts | 101/363 X |
| 2,856,848 | 10/1958 | Pritchard . | |
| 2,898,849 | 8/1959 | Gillies . | |
| 2,934,005 | 4/1960 | Gemelli . | |
| 3,131,415 | 5/1964 | Dapses . | |
| 3,205,816 | 9/1965 | Heimlicher . | |
| 3,308,754 | 3/1967 | Munn . | |
| 3,333,535 | 8/1967 | Behringer | 101/363 |
| 3,635,153 | 1/1972 | Gartside . | |
| 3,641,932 | 2/1972 | Behringer | 101/366 |
| 3,709,143 | 1/1973 | Rundell . | |
| 3,739,717 | 6/1973 | Brown et al. . | |
| 3,976,007 | 8/1976 | Junghans et al. . | |
| 4,009,657 | 3/1977 | Bonanno et al. | 101/157 |
| 4,044,677 | 8/1977 | Hamisch, Jr. . | |
| 4,066,014 | 1/1978 | van Haaften . | |
| 4,077,317 | 3/1978 | Kiesewetter et al. . | |
| 4,198,907 | 4/1980 | Switall . | |
| 4,299,163 | 11/1981 | Raahauge . | |
| 4,497,250 | 2/1985 | Dressler | 101/350 |
| 4,526,102 | 7/1985 | Grobman . | |
| 4,716,826 | 1/1988 | Gibellino et al. . | |
| 4,864,925 | 9/1989 | Van Kanegan et al. . | |
| 4,879,951 | 11/1989 | Yoshida et al. . | |
| 4,905,588 | 3/1990 | Hara . | |
| 4,938,133 | 7/1990 | Bock et al. . | |
| 4,945,832 | 8/1990 | Odom . | |
| 4,982,660 | 1/1991 | Hamm et al. . | |
| 5,003,876 | 4/1991 | Harrison et al. . | |

FOREIGN PATENT DOCUMENTS

| | | |
|---|---|---|
| 2452636 | 5/1976 | Germany . |
| 57-146657 | 9/1982 | Japan . |

OTHER PUBLICATIONS

FLEXO Magazine, May 1993; 3 page article; "Technological Improvements: A Look at The Last Ten Years" by John Kienzle.

*Primary Examiner*—J. Reed Fisher
*Attorney, Agent, or Firm*—Barnes & Thornburg

[57] ABSTRACT

An inking apparatus is provided for applying ink to a rotating roller of a printing press. The apparatus includes an ink fountain located adjacent the roller for applying ink to the roller, a doctor blade holder, and a doctor blade coupled to the doctor blade holder for engaging the roller with a predetermined pressure to scrape excess ink from the roller as the roller rotates relative to the doctor blade. The apparatus also includes first and second guide rails configured to define a slot therebetween for receiving the doctor blade holder therein, and a mechanism for retaining the doctor blade holder in the slot to hold the doctor blade against the roller during rotation of the roller.

24 Claims, 4 Drawing Sheets

INKING SYSTEM FOR A PRINTING PRESS

BACKGROUND AND SUMMARY OF THE INVENTION

The present invention relates generally to inking systems for printing presses. More particularly, the present invention relates to an apparatus for applying ink to an anilox roller which then applies ink to a plate cylinder of a printing press.

Many types of printing presses are well known. The present invention is especially designed for use with Flexographic or "Flexo" printing presses. However, it is understood that the present invention may be used in other printing systems. Flexo printing presses include an impression cylinder, a plate cylinder and an engraved anilox roller which is used to meter the flow of ink to a plate cylinder.

Letterpress keyless printing systems and offset keyless printing systems also include anilox rollers. However, letterpress keyless and offset keyless printing systems include additional rollers located between the anilox roller and the plate cylinder. These additional rollers transfer ink from the anilox roller to the plate cylinder. Therefore, letterpress keyless and offset keyless printing systems indirectly apply ink the plate cylinder. Water based inks cannot be practically applied with indirect inking systems. In Flexo printing systems, ink is transferred directly from the anilox roller to the plate cylinder. Therefore, Flexo printing systems can use water based inks.

Conventional Flexo printing systems include fountain type inking systems. Each anilox roller in a conventional Flexo printing system includes a pair of spaced apart reverse angle doctor blades which engage the anilox roller and define an inking chamber therebetween. An ink fountain supplies ink to the inking chamber so that a well of ink is formed between the anilox roller and the doctor blades. One doctor blade scraps off excess ink from the anilox roller while the other doctor blade holds ink in the inking chamber. Ink is applied to the anilox roller as the anilox roller rotates through the well of ink. An ink reservoir situated below the inking chamber traps run off ink and resupplies it to the inking chamber. Examples of conventional fountain type inking systems are illustrated in U.S. Pat. Nos. 2,151,968; 4,938,133; and 4,982,660.

The present invention provides an improved design over conventional fountain type inking systems normally used in modern presses. Conventional fountain type inking systems often have a number of problems. First, ink skipping may occur in fountain type inking systems. Ink skipping causes streaks in which there is no ink on the surface of the anilox roller. As the printing speed is increased, the ink skipping problem becomes more pronounced. Modern printing presses operate at very high speeds. Therefore, ink skipping has become a relatively serious problem. Ink skipping primarily results from bubbles formed in the ink as the anilox roller passes through the inking chamber at high speeds. These bubbles create air pockets that isolate the ink from the surface of the anilox roller and cause the inkless streaks on the anilox roller. This prevents the anilox roller surface from supplying ink to cover the plate cylinder. One object of the present invention is to reduce the problem of ink skipping.

Another problem associated with fountain type inking systems is that leakage may occur at end seals of the fountain. The doctor blades and various other components of fountain type inking systems may also leak. Leakage may cause a build up of ink on the impression roller and the plate cylinder.

Yet another problem associated with fountain-type inking systems is that the doctor blade is difficult to change. This results in lengthy printing press down times when it is necessary to change the doctor blade. One object of the present invention is to provide a reversible doctor blade assembly which facilitates changing of the doctor blade and reduces press down time.

Fountain type inking systems also tend to splash or throw off ink as the anilox roller moves through the fountain. Such ink spillage problems have made it necessary to provide a complex system of seals around a major portion of the anilox roller in fountain type inking systems. Even with the most effective seals, however, some leakage is typically present. Ink leakage may result in damage to the printed product from ink that leaks onto the paper web. In addition, the ink leakage problem makes cleaning the press more costly, both in terms of manpower requirements and press down time. The inking apparatus of the present invention is designed to reduce the abovementioned problems.

Another object of the present invention is to provide an ink fountain for applying ink to the anilox roller without substantial leakage and which can be cleaned easily.

According to one aspect of the present invention, an inking apparatus is provided for applying ink to a rotating roller of a printing press. The apparatus includes an elongated ink manifold located adjacent the roller, and a plurality of spray nozzles coupled to the manifold. The plurality of spray nozzles are spaced along the manifold for spraying ink onto the roller. The apparatus also includes a wiper for engaging the roller to remove excess ink from the roller. The wiper is located adjacent the roller and is spaced apart from the manifold. The apparatus further includes a spray chamber surrounding the manifold and wiper for containing excess ink therein.

The apparatus further includes an ink supply, a water supply, and a valve coupled to the ink supply, the water supply, and to the manifold. The valve controls the supply of ink and water to the manifold. The valve selectively supplies ink, water, or a mixture of ink and water to the manifold.

An illustrated embodiment of the inking apparatus is used in a printing press system which includes an impression cylinder, a plate cylinder, and an anilox roller for supplying ink to the plate cylinder upon rotation of the anilox roller and plate cylinder. The inking apparatus includes an ink sprayer located adjacent the anilox roller for spraying ink onto the anilox roller, and a wiper located adjacent the anilox roller and spaced apart from the ink sprayer. The wiper engages the anilox roller to remove excess ink from the anilox roller as the anilox roller rotates. The apparatus also includes a spray chamber surrounding the ink sprayer and wiper for containing excess ink therein.

The present invention improves and simplifies printing on a Flexographic or other types of printing presses. Ink, water, or a mixture of ink and water coming from separate supply lines flows through the ink and water control valve. The supply lines are coupled to check valves to permit a programmable controller on the press to supply ink, water, or a mixture of ink and water to the spray manifold.

The angle of alignment between the plurality of spray nozzles and the roller is preferably adjustable. The spray manifold is movable over a range of at least 90° so that the manifold can accommodate different press designs and printing needs. The rate of fluid flow from spray nozzles coupled to the spray manifold can also be adjusted for metering the amount of ink applied to the anilox roller.

The wiper for removing excess ink from the anilox roller is also adjustable over a range of angles of at least 180°. This provides control over inking of the anilox roller and both forward and reverse couples. A press operator can select an appropriate angle for the wiper to best suit the operator's printing needs.

The present invention is designed to increase the useful life of an anilox roller. In addition, ink cost is reduced because the spray nozzles can be adjusted to deliver only the amount of ink needed. Using the inking apparatus of the present invention, a press can run longer and have less chance of extended down time without maintenance. The inking system and wiper designs of the present invention reduce waste, decrease clean-up time, lower labor cost, and lessen the extra cost associated with extensive waste water treatment systems that may be required with conventional inking systems.

According to another aspect of the invention, an inking apparatus for applying ink to a rotating roller of a printing press. The apparatus includes an ink fountain located adjacent the roller for applying ink to the roller, a doctor blade holder, and a doctor blade coupled to the doctor blade holder for engaging the roller with a predetermined pressure to scrape excess ink from the roller as the roller rotates relative to the doctor blade. The apparatus also includes first and second guide rails configured to define a slot therebetween for receiving the doctor blade holder therein, and means for retaining the doctor blade holder in the slot to hold the doctor blade against the roller during rotation of the roller.

The ink fountain includes an angle iron located adjacent the roller to define an ink reservoir therebetween and an elongated supply pipe located in the ink reservoir for supplying ink to the ink reservoir. The apparatus further includes an ink supply, a water supply, and a valve coupled to the ink supply, the water supply, and to the supply pipe. The valve selectively controls the supply of ink, water, or a mixture of ink and water to the supply pipe. Preferably, the valve is coupled to the supply pipe at a location near a midpoint of the supply pipe.

The elongated supply pipe is formed to include a plurality of elongated slots therein for discharging ink from the supply pipe into the ink reservoir. The plurality of elongated slots are spaced apart along a longitudinal axis of the supply pipe.

The retaining means includes a mounting plate coupled to the second guide rail for covering the slot to retain the doctor blade holder in the slot. The retaining means also includes means for engaging the doctor blade holder to hold the doctor blade against the roller during vibration of the printing press.

Other objects, advantages, and novel features of the present invention will become apparent from the following detailed description of the invention when considered in conjunction with the accompanying drawings.

BRIEF DESCRIPTION OF THE DRAWINGS

The detailed description particularly refers to the accompanying figures in which.

DETAILED DESCRIPTION OF THE DRAWINGS

Figure 1:
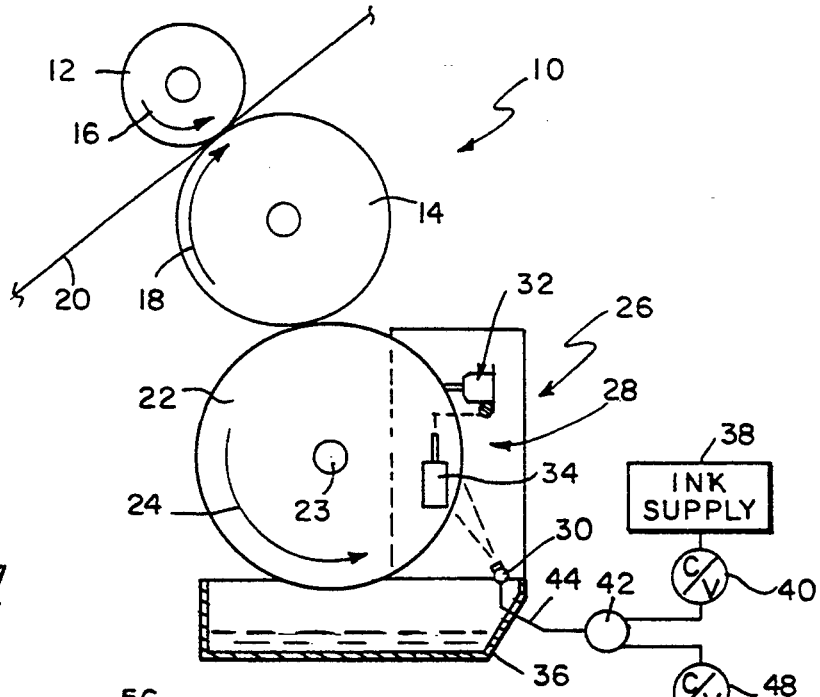
FIG. 1 is a diagrammatical view of a Flexographic printing system including the inking apparatus of the present invention.

Referring to FIG. 1, a Flexo printing system 10 is illustrated. The Flexo system 10 includes an impression cylinder 12 and a plate cylinder 14. The impression cylinder is rotated in the direction of arrow 16, and plate cylinder 14 is rotated in the direction of arrow 18 to apply an image to a paper web 20 moving between the impression cylinder 12 and the plate cylinder 14. In the Flexo system 10, ink is applied directly to plate cylinder 14 by an anilox roller 22 which rotates in the direction of arrow 24 about an axis of rotation 23.

An inking apparatus 26 of the present invention is designed to apply a metered amount of ink to anilox roller 22. The inking apparatus 26 includes a spray chamber 28, a spray manifold 30, a wiper assembly 32, a control cylinder 34, and an ink reservoir 36. In some press arrangements, ink drains from reservoir 36 to a primary ink supply which may be remotely located. An ink supply 38 is coupled through check valve 40 to a control valve 42. Control valve 42 is coupled to manifold 30 by conduit 44. A cleaning fluid supply 46 is coupled through check valve 48, control valve 42, and conduit 44 to manifold 30. Preferably, the cleaning fluid is water. However, other types of cleaning fluid may be used with the present invention. A programmable controller (not shown) on the press may be used to control check valves 40 and 48 to supply ink, water (or other fluid), or a mixture of ink and water from ink supply 38 and cleaning fluid supply 46 to spray manifold 30.

Figure 2:
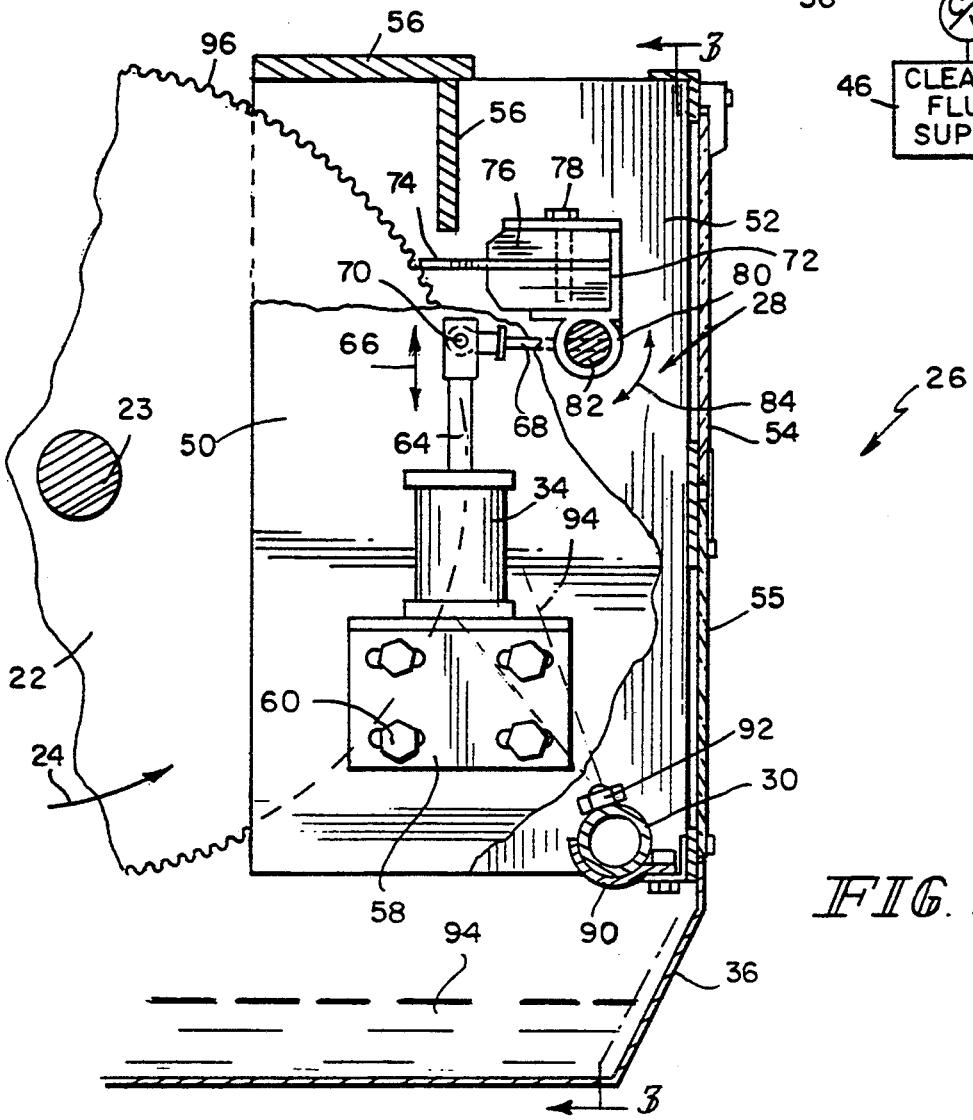
FIG. 2 is an end view of the inking apparatus of FIG. 1 with portions broken away to illustrate the details of a spray chamber, a spray manifold, and a wiper assembly of the present invention.
Figure 3:
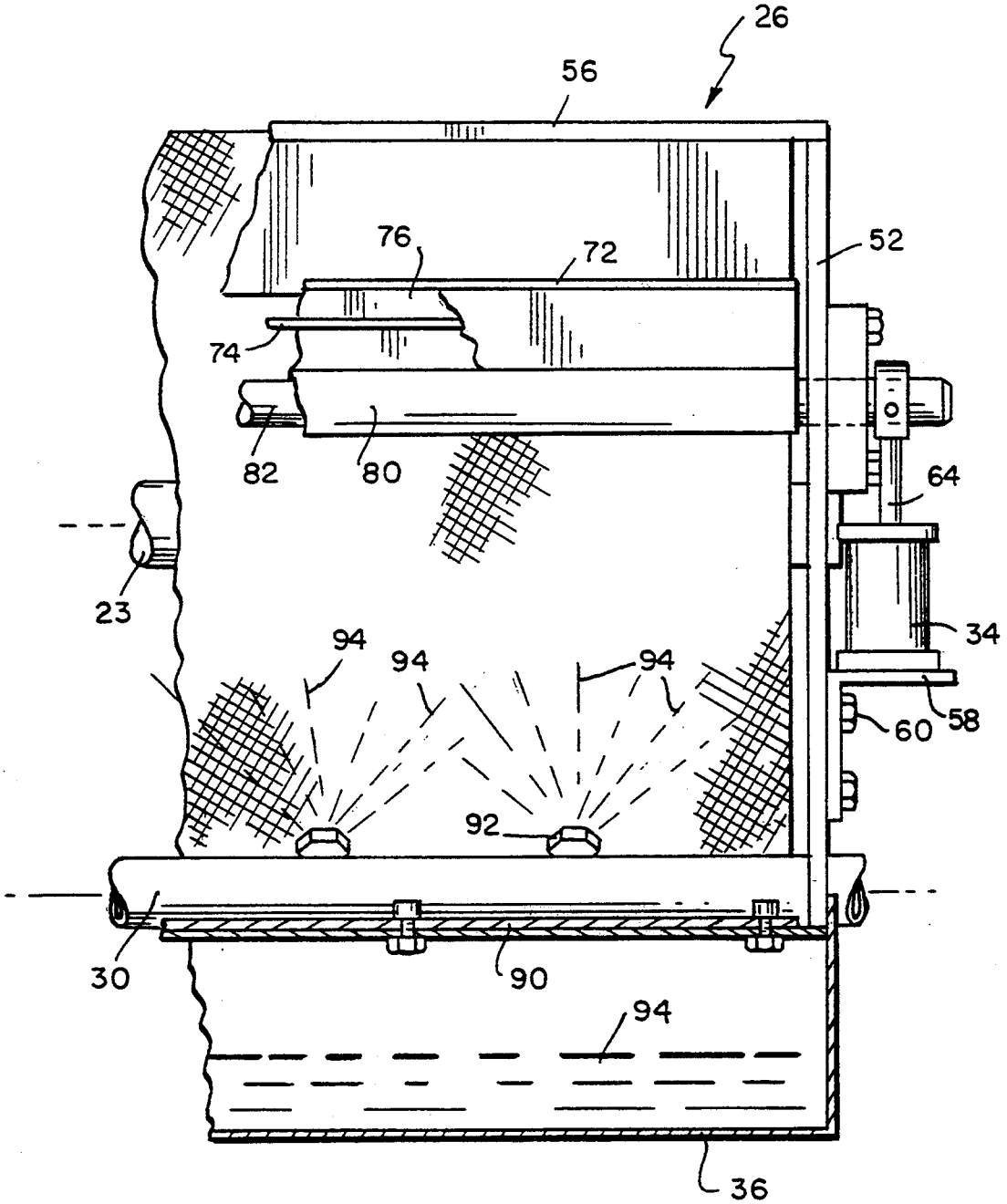
FIG. 3 is a sectional view taken along lines 3—3 of FIG. 2 illustrating a plurality of spray nozzles spaced along the spray manifold.

The inking system 26 of the present invention is illustrated in detail in FIGS. 2 and 3. Spray chamber 28 includes a first end panel 50, a second end panel 52, front panels 54 and 55, and press brackets 56 which define a substantially closed chamber 28 for containing excess ink therein. An L-shaped support bracket 58 is coupled to each end wall 50 with suitable fasteners 60. An air cylinder 34 is coupled to each bracket 58. Air cylinder 34 includes an actuator arm 64 which moves up and down in the direction of arrow 66. A control rod 68 is coupled to a distal end of actuator arm 64 by a clevis coupling 70.

Wiper assembly 32 includes a frame 72, a wiper or doctor blade 74, and a doctor blade support member 76. Doctor blade support member 76 is coupled to frame 72 by fasteners 78. Support member 76 can accommodate doctor blades 74 having various sizes. Support member 76 can be replaced quickly by removing fasteners 78. A shaft 80 is rigidly coupled to frame 72. Shaft 80 rotates around a bushing or bearing 82. Control rod 68 is coupled to shaft 80. Therefore, movement of actuator arm 64 in the direction of double-headed arrow 66 causes rotational movement of shaft 80 around bushing or bearing 82 in the direction of double-headed arrow 84. Such rotation of shaft 80 causes movement of doctor blade assembly 32 along a 180° arc from a first position in which doctor blade 74 faces downwardly toward spray manifold 30 when actuator arm 64 is in a retracted position to an upwardly extending position in which doctor blade 74 is directed upwardly substantially parallel to front panel 54 when actuator arm 64 is in an extended position.

Spray manifold 30 is rotatably coupled to the spray chamber 28 by clamps 90. Spray manifold 30 is located adjacent roller 22, spaced apart from roller 22 by a predetermined distance. Spray manifold 30 is an elongated tube situated substantially parallel to the longitudinal axis of rotation 23 of anilox roller 22. A plurality of spray heads or nozzles 92 are coupled to spray manifold 30 in a spaced apart relation for spraying liquid 94 in a predetermined pattern on anilox roller 22. Spray manifold 30 can be adjusted to change the angle of alignment between nozzles 92 and roller 22. The spray manifold 30 is rotatable on clamps 90 over a range of at least 90°. This rotation changes the angle of alignment of nozzles 92 relative to roller 22 to accommodate different press designs and printing needs.

In operation, the ink applying apparatus 26 of the present invention is situated adjacent anilox roller 22 of Flexo printing system 10. It is understood, however, that the ink applying apparatus 26 may be used to apply ink to an anilox roller of a letterpress keyless printing system, an offset keyless printing system, or another suitable printing system. Anilox roller 22 is designed to deliver a consistent, predetermined amount of ink to plate cylinder 14. Anilox roller 22 includes an engraved outer surface 96 as illustrated in FIG. 2.

Ink 94 is applied to the surface 96 of rotating anilox roller 22 by the plurality of spray nozzles 92 coupled to spray manifold 30. About 3–4 nozzles 92 are provided for each page being printed. Therefore, a typical manifold 30 will include 12–16 spray nozzles 92. Ink under pressure is supplied to manifold 30 by ink supply 38. Therefore, as anilox roller 22 rotates in the direction of arrow 24, ink 94 is sprayed from nozzles 92 onto surface 96.

Doctor blade 74 is held at a predetermined tension against surface 96 of anilox roller 22 by actuator arm 34 and cylinder 92. Doctor blade 74 meters the amount of ink 94 present on surface 96 of anilox roller 22 by removing excess ink from surface 96 of roller 22 as roller 22 rotates. Ink which is not carried within the individual cells of engraved surface 96 is scraped or doctored from the surface 96 of anilox roller 22 by doctor blade 74. The angle and amount of force applied by doctor blade 74 against the surface 96 of anilox roller 22 may be adjusted by moving actuator arm 64 of cylinder 34. Doctor blade 74 is adjustable over a range of angles of at least 180°. This permits control over inking of the roller 22 in both forward and reverse couples.

The rate of fluid flow from spray nozzles 92 coupled to spray manifold 30 can be adjusted for metering the amount of ink 94 applied to roller 22. In other words, inking apparatus 26 uses only the amount of ink 94 required to coat surface 96 of roller 22. Ink cost is cut dramatically because the spray nozzles 92 can be adjusted to deliver only the amount of ink needed to coat roller 22. Nozzles 92 can also be adjusted to provide narrower or wider spray patterns to coat the surface 96 of roller 22. Spray chamber 28 provides an enclosure for containing excess ink 94 from nozzles 92 which is not applied to surface 96 of roller 22. The excess ink 94 collects in reservoir 36 below spray chamber 28. Because the present invention uses less ink, containment of the ink 94 is less burdensome than conventional inking systems. Therefore, the present inking apparatus 26 reduces the likelihood of ink spillage or leakage. It is not necessary to provide the elaborate system of seals around roller 22 that is typically required in fountain type inking systems.

After a press run, cleaning fluid (preferably water) is supplied to manifold 30 from cleaning fluid supply 46. This cleans manifold 30, nozzles 92 and roller 22. By using the same spray manifold 30 for both inking and clean up, the present invention reduces clean up costs and press down time and saves space compared to conventional inking systems. Because ink 94 is sprayed on the surface 96 of roller 22, the problem of ink skipping is reduced by the inking apparatus 26 of the present invention. Roller 22 does not have to pass through a well of ink which generates bubbles that can cause ink skipping in conventional fountain type inking systems.

Another embodiment of the present invention is illustrated in FIGS. 4–8. In this embodiment, inking apparatus 100 is designed to apply a metered amount of ink to anilox roller 22 in the Flexo system 10 illustrated in FIG. 1. In other words, inking apparatus 100 is designed to replace the inking apparatus 26 illustrated in FIG. 1.

Figure 4:
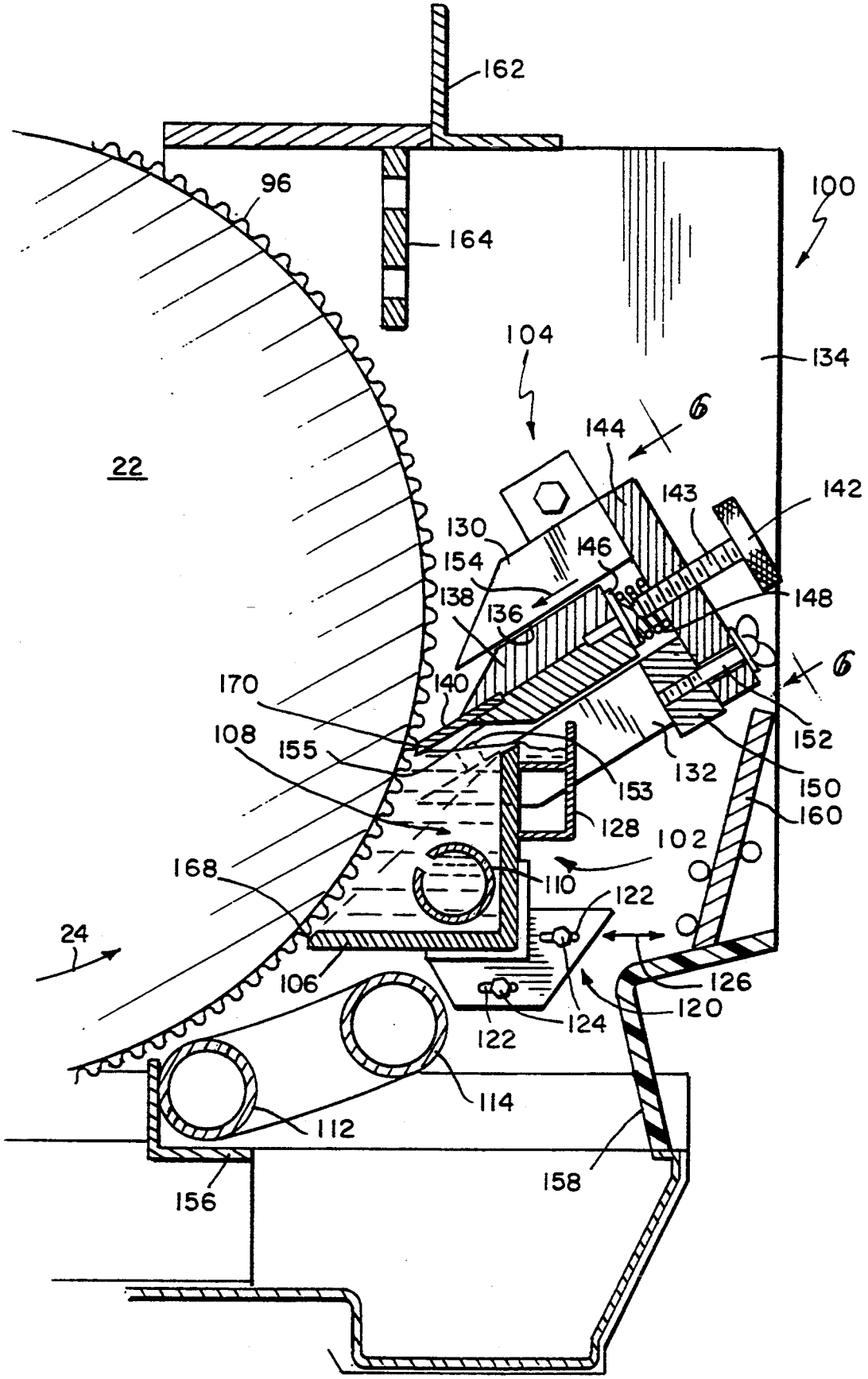
FIG. 4 is a sectional view taken through another embodiment of an inking apparatus of the present invention including an open ink fountain for applying ink to the anilox roller and an easily reversible doctor blade mounted above the open ink fountain for metering the amount of ink applied to the anilox roller as the anilox roller rotates about its axis of rotation.
Figure 5:
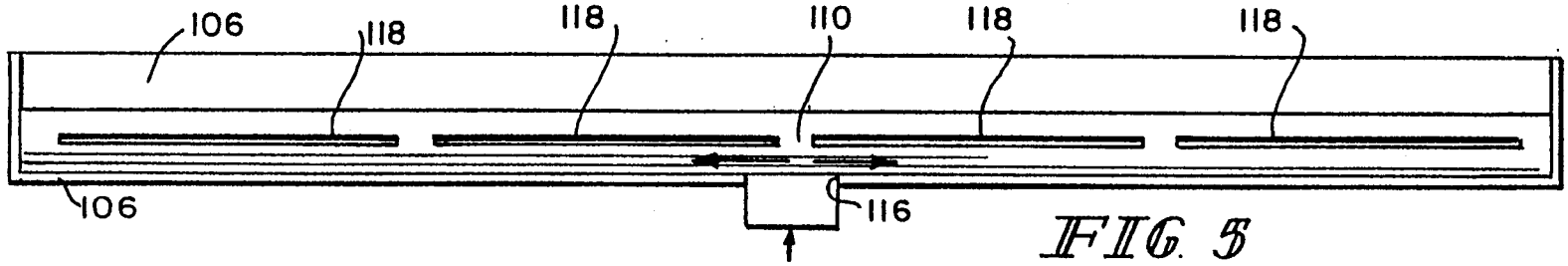
FIG. 5 is a sectional view illustrating an ink supply pipe having a plurality of elongated slots formed therein for supplying ink to the open fountain defined by an angle iron adjacent the roller.
Figure 7:
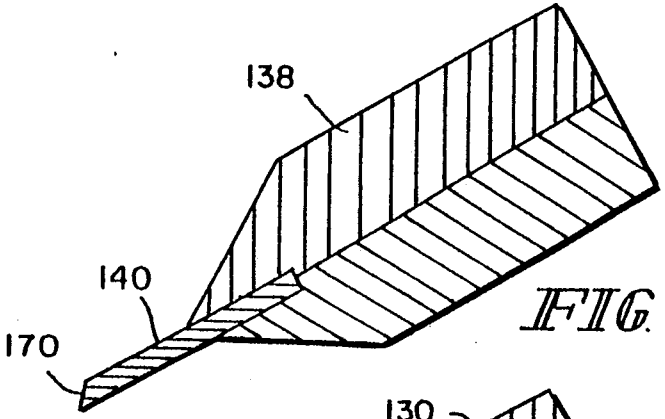
FIG. 7 is diagrammatical view of a doctor blade holder and doctor blade arranged in a first orientation after a tip of the doctor blade has been bevelled by rotation of the anilox roller.
Figure 8:
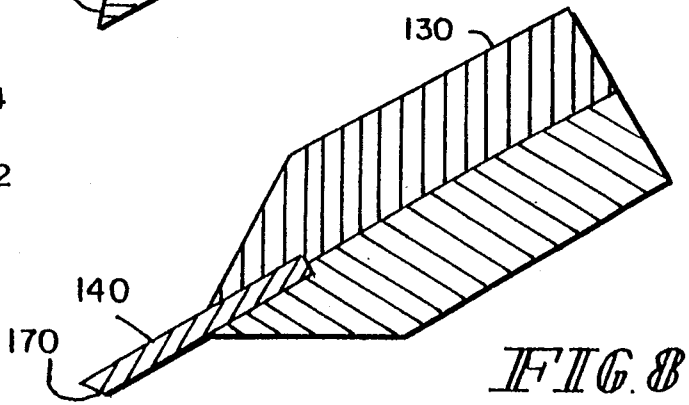
FIG. 8 illustrates the orientation of the doctor blade after it has been reversed so that the non-bevelled side of the doctor blade engages the anilox roller.

As illustrated in FIG. 4, inking apparatus 100 includes an open ink fountain 102 for applying ink to outer surface 96 of anilox roller 22 and a doctor blade assembly 104 for metering the amount of ink on outer surface 96 of anilox roller 22. Ink fountain 102 includes an angle iron 106 located adjacent roller 22 which defines an ink reservoir 108 between angle iron 106 and outer surface 96 of anilox roller 22. A 3/8 inch PVC ink supply pipe 110 is located within ink reservoir 108. Ink and water are supplied to pipe 110 through supply lines 112 and 114, respectively, using the ink and water supply system illustrated in FIG. 1 and discussed in detail above. As best illustrated in FIG. 5, ink or water is supplied from control valve 42 through an inlet 116 to pipe 110. Pipe 110 is formed to include a plurality of elongated slots 118 spaced longitudinally along pipe 110. Ink or water flowing through inlet 116 enters pipe 110 and is discharged into ink reservoir 108 through slots 118. In the illustrated embodiment of the invention, four slots 118 are provided. The spaced apart slots increase the strength of pipe 10 as opposed to one continuous slot. It has also been discovered that locating inlet 116 near the center or midpoint of pipe 110 is more effective than supplying ink or water to one end of pipe 110.

The position of angle iron 106 is adjustable relative to roller 22 by adjusting the position of mounting bracket 120. Illustratively, mounting bracket 120 includes slots 122 for receiving fasteners 124 therein. This permits adjustment of the position of angle iron 106 back and forth in the direction of double-headed arrow 126. An ink overflow rail 128 is coupled to angle iron 106. Overflow rail 128 catches ink or water which may spill over the top of angle iron 106 and directs excess ink or water back into a drain.

Doctor blade assembly 104 includes the first and second guide rails 130 and 132 coupled to opposite end panels 134 of inking apparatus 100. First and second guide rails 130 and 132 form a guide track which defines a slot 136 for receiving doctor blade holder 138 therein. Doctor blade holder 138 holds doctor blade 140 against outer surface 96 of anilox roller 22. Doctor blade assembly includes a threaded hand wheel 142 threadably coupled to mounting plate 144 for retaining doctor blade holder 138 inside slot 136. A swivel plate 146 is mounted on an opposite end of a threaded shaft 143 from hand wheel 142. A biasing spring 148 is located between swivel plate 146 and mounting plate 144. Mounting plate 144 is releasable coupled to plate 150 by threaded fastener 152.

As discussed above, guide rails 130 and 132 and hand wheels 142 are located at each end of inking apparatus 100 to guide the position of doctor blade holder 138 and hold the doctor blade 138 against anilox roller 22 with a predetermined force. Tension on doctor blade holder 138 can be adjusted by rotating hand wheel 142 so that swivel plate 146 applies a biasing force to doctor blade holder 138 in the direction of arrow 154. Normally, little or no force is required against doctor blade holder 138. Swivel plate 146 abuts doctor blade holder to prevent doctor blade 140 from moving away from roller 22 due to vibration. Hand wheel 142 is rotatable relative to mounting plate 144 to adjust the pressure of doctor blade 140 against roller 22 to provide proper inking of roller 22.

Doctor blade assembly 104 further includes a stop member 153 rigidly coupled to second guide rail 132. Stop member 153 is configured to engage a leading surface 155 of doctor blade holder 138 to prevent engagement of doctor blade holder 138 with surface 96 of anilox roller 22 which would damage the anilox roller 22.

Inking apparatus 100 illustrated in FIG. 4 includes support brackets 156 and 158 for holding and aligning side plates 134. Support brackets 156 and 158 are illustratively made of fiberglass and are aligned in an angle to prevent ink and water from building up on support brackets 156 and 158. It is understood that support brackets 156 and 158 may be made from steel, plastic, or any other suitable material. Inking apparatus 100 further includes a drip guard 160, a safety guard 162, and a mounting plate for coupling inking apparatus 100 to a printing press.

Figure 6:
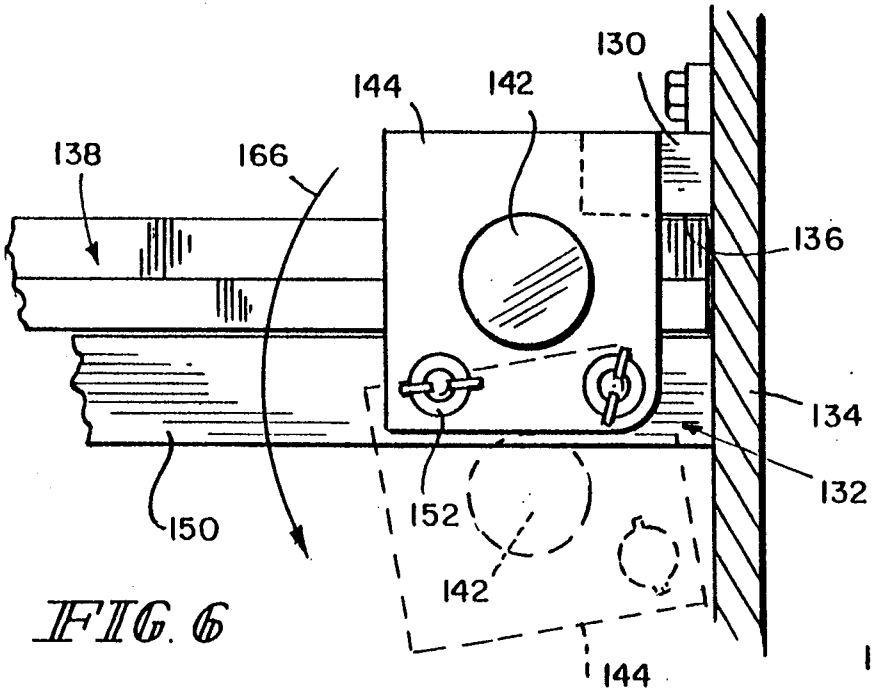
FIG. 6 is a partial sectional view taken along lines 6—6 of FIG. 4 illustrating the configuration of one of the guide tracks for coupling the doctor blade to the inking apparatus to facilitate reversal or replacement of the doctor blade.

As illustrated in FIG. 6, fastener 152 can be removed from plate 150 to permit pivotal movement of coupling plate 144 in the direction of arrow 166 to the dotted position illustrated in FIG. 6. This opens slot 136 to permit removal or insertion of doctor blade holder 138 from slot 136. After doctor blade holder 138 is installed into slot 136, mounting plate 144 is rotated back to the solid-line position illustrated in FIG. 6 and hand wheel 142 is rotated so that swivel plate 146 applies a desired biasing force against doctor blade holder 138 to hold doctor blade 140 against outer surface 96 of anilox roller 22.

In operation, angle iron 106 is adjusted so that about 0.002 inch clearance is provided between a leading edge 168 of angle iron 106 and outer surface 96 of anilox roller 22. Anilox roller 22 rotates in the direction of arrow 24. Initially, some slight leakage may occur between edge 168 of angle iron 106 and anilox roller 22. However, after anilox roller 22 reaches its normal operating speed leakage stops. Doctor blade holder 138 is then loaded into slot 136 and a predetermined force is applied using hand wheels 142 at opposite ends of inking apparatus 100. Ink is supplied to ink supply pipe 110 using the ink supply and cleaning fluid supply disclosed in FIG. 1 to fill ink reservoir 106 of ink fountain 102. Ink must be supplied to ink reservoir 108 at a level above the end edge 170 of doctor blade 140. This prevents foaming and rooster tailing. Plastic side panels 134 contact end edges of anilox roller 22 with a zero tolerance to eliminate the need for the elaborate system of seals around roller 22 that is typically required in fountain type inking systems. Side panels 134 are illustratively made from polypropylene so that ink does not stick to side panels 134 at opposite ends of anilox roller 22.

End edge 170 of doctor blade 140 meters the amount of ink applied to outer surface 96 of anilox roller 22. After doctor blade 140 has been used for some time, end edge 170 becomes bevelled at an angle best illustrated in FIG. 7. After end edge 170 of doctor blade 140 becomes worn in this manner, it is necessary to change or replace doctor blade 140. Advantageously, the present invention facilitates changing doctor blade 140. Doctor blade holder 138 is advantageously reversible. By loosening fasteners 152 and pivoting mounting plates at opposite ends of inking apparatus 100 out of the way of slot 136, doctor blade holder 138 may be removed from slot 136. Doctor blade holder 138 is then rotated end-for-end and repositioned within slot 136 quickly and efficiently. The non-worn side of end edge 170 of doctor blade 140 is aligned to engage outer surface 96 of anilox roller 22. Therefore, the apparatus of the present invention advantageously permits the use of a square tip doctor blade. Preferably, doctor blade 140 is angled at about a 32° angle relative to surface 96 of anilox roller 22. This angle is adjustable. Hand wheels 142 are mainly provided to prevent the effects of vibration on doctor blade 140. Little or no pressure is required against doctor blade holder 138 by swivel plate 146. Spring 148 may be omitted. Spring 148 simply provides an extra precaution against the effects of vibration during press operation. The configuration of doctor blade assembly 104 which permits the doctor blade holder 138 to be quickly reversed and put back into operation reduces press down time substantially.

Although the present invention is especially designed for use with a Flexo printing press 10, it is understood that the present invention can be used in other printing systems. For example, in some instances the present invention can be used in letterpress keyless printing systems and offset keyless printing systems.

Although the invention has been described and illustrated in detail, it is to be clearly understood that the same is intended by way of illustrations and example only and is not to be taken by way of limitation. The spirit and scope of the invention are to be limited only by the terms of the impended claims.

What is claimed is:

1. An inking apparatus for applying ink to a rotating roller of a printing press, the apparatus comprising:

an ink fountain located adjacent the roller for applying ink to the roller;

a doctor blade holder;

a doctor blade coupled to the doctor blade holder for engaging the roller with a predetermined pressure to scrape excess ink from the roller as the roller rotates relative to the doctor blade;

first and second guide rails configured to define a slot therebetween for receiving the doctor blade holder therein, the slot including a first open end through which the doctor blade and doctor blade holder are placed and a second open end through which the doctor blade extends; and means adjacent the first open end of the slot for retaining the doctor blade holder in the slot to hold the doctor blade against the roller during rotation of the roller, the retaining means configured to be movable to a position away from the slot so that the doctor blade holder can be removed from the slot through the first open end thereof.

2. The apparatus of claim 1, wherein the ink fountain includes an angle iron located adjacent the roller to define an ink reservoir therebetween and an elongated supply pipe located in the ink reservoir for supplying ink to the ink reservoir.

3. The apparatus of claim 2, wherein a leading edge of the angle iron is spaced apart from the roller by about 0.002 inch.

4. The apparatus of claim 2, further comprising an ink supply, a water supply, and a valve coupled to the ink supply, the water supply, and to the supply pipe, the valve controlling the supply of ink and water to the supply pipe.

5. The apparatus system of claim 4, wherein the valve selectively supplies ink, water, or a mixture of ink and water to the supply pipe.

6. The apparatus of claim 4, wherein the valve is coupled to the supply pipe at a location near a midpoint of the supply pipe.

7. The apparatus of claim 2, wherein the roller has an axis of rotation, and the elongated supply pipe is positioned substantially parallel to said axis of rotation.

8. The apparatus of claim 2, wherein the elongated supply pipe is formed to include a plurality of elongated slots therein for discharging ink from the supply pipe into the ink reservoir.

9. The apparatus of claim 8, wherein the plurality of elongated slots are spaced apart along a longitudinal axis of the supply pipe.

10. The apparatus of claim 1, wherein the first and second guide rails are configured to align the doctor blade at a predetermined angle relative to the roller.

11. The apparatus of claim 10, wherein the predetermined alignment angle of the doctor blade relative to the roller is about 32°.

12. The apparatus of claim 10, wherein the predetermined angle of the doctor blade relative to the roller is adjustable.

13. The apparatus of claim 1, wherein the retaining means includes a mounting plate coupled to the second guide rail for covering the slot to retain the doctor blade holder in the slot.

14. The apparatus of claim 13, wherein the retaining means also includes means for engaging the doctor blade holder to hold the doctor blade against the roller during vibration of the printing press.

15. The apparatus of claim 14, wherein the engaging means includes a hand wheel threadably coupled to the mounting plate for adjusting the pressure of the doctor blade against the roller to provide proper inking of the roller.

16. The apparatus of claim 1, wherein the doctor blade holder is reversible.

17. In a printing press system including an impression cylinder, a plate cylinder, and an anilox roller for supplying ink to the plate cylinder upon rotation of the anilox roller and plate cylinder, the improvement comprising:

first and second spaced apart side walls abutting opposite ends of the anilox roller;

means located adjacent the anilox roller for applying ink onto the anilox roller;

a doctor blade holder;

a doctor blade coupled to the doctor blade holder for engaging the anilox roller with a predetermined pressure to scrape excess ink from the anilox roller as the roller rotates relative to the doctor blade;

first and second guide tracks coupled to the first and second side walls, respectively, to define a slot for holding the doctor blade holder therein;

a mounting plate coupled to one of the first and second guide tracks and movable between a first position adjacent the first and second guide tracks for covering the slot to retain the doctor blade holder in the first and second guide tracks and a second position away from the slot to allow removal of the doctor blade holder therefrom; and means for engaging the doctor blade holder to hold the doctor blade against the anilox roller during rotation of the anilox roller.

18. The improvement of claim 17, further comprising an ink supply, a water supply, and a valve coupled to the ink supply, the water supply, and to the ink applying means, the valve controlling the supply of ink and water to the ink applying means.

19. The improvement of claim 18, wherein the valve selectively supplies ink, water, or a mixture of ink and water to the ink applying means.

20. The improvement of claim 18, wherein the ink applying means includes an elongated manifold and a plurality of spray nozzles coupled to the manifold, the plurality of spray nozzles being spaced along the manifold for spraying ink onto the roller.

21. The improvement of claim 17, wherein the doctor blade holder is reversible in the first and second guide tracks.

22. The improvement of claim 17, wherein the ink applying means includes:

an angle iron located adjacent the roller to define an ink reservoir therebetween;

an elongated supply pipe located in the ink reservoir for supplying ink to the ink reservoir, the elongated supply pipe being formed to include a plurality of elongated slots therein for discharging ink from the supply pipe into the ink reservoir; and means for supplying ink to the supply pipe.

23. The improvement of claim 17, further comprising means for adjusting the engaging means to change the pressure of the doctor blade against the anilox roller to provide proper inking of the anilox roller.

24. An inking apparatus for applying ink to a rotating roller of a printing press, the apparatus comprising:

an ink reservoir located adjacent the roller for supplying ink to the roller;

an elongated supply pipe located in the ink reservoir for supplying ink to the ink reservoir;

means for supplying ink to the supply pipe;

means separate from the ink reservoir for wiping excess ink from the roller after the roller rotates through the ink reservoir;

a doctor blade holder;

a doctor blade coupled to the doctor blade holder for engaging the roller with a predetermined pressure to scrape excess ink from the roller as the roller rotates relative to the doctor blade;

first and second guide rails configured to define a slot therebetween for receiving the doctor blade holder therein through an open end of the slot; and plate means movably coupled to one of the first and second guide rails for retaining the doctor blade holder in the slot when the plate means is in a first position adjacent the slot to hold the doctor blade against the roller during rotation of the roller and for allowing the doctor blade holder to be removed from the slot through the open end thereof when the plate means is in a second position away from the slot.

* * * * *